United States Patent [19]

Cabernoch

[11] Patent Number: 4,640,425

[45] Date of Patent: Feb. 3, 1987

[54] ONE-PIECE NURSING CONTAINER WITH MEANS FOR STORING NIPPLE

[75] Inventor: James L. Cabernoch, Cary, Ill.

[73] Assignee: Baxter Travenol Laboratories, Inc., Deerfield, Ill.

[21] Appl. No.: 599,425

[22] Filed: Apr. 12, 1984

[51] Int. Cl.[4] ..... A61J 9/00; A61J 11/00; B65D 85/72

[52] U.S. Cl. ..... 215/11 E; 215/11 R; 222/94; 222/107; 222/490; 222/541; 426/115; 426/117

[58] Field of Search ..... 215/11 R, 11 E, 11 C; 206/219, 222; 222/107, 94, 92, 490, 541; 383/113, 38; 426/117, 115; 53/456

[56] References Cited

U.S. PATENT DOCUMENTS

| | | | |
|---|---|---|---|
| 2,446,451 | 8/1948 | Allen | 215/11 |
| 2,524,021 | 9/1950 | Rigby et al. | 215/11 |
| 2,541,934 | 2/1951 | Piazze | 215/11 |
| 2,604,222 | 7/1952 | Teague et al. | 215/11 |
| 2,628,909 | 2/1953 | Horan | 99/171 |
| 2,687,130 | 8/1954 | Cohen | 206/222 |
| 2,947,653 | 8/1960 | Fohr | 222/107 X |
| 2,956,702 | 10/1960 | Ransom | 215/11 |
| 2,987,208 | 6/1961 | Ransom | 215/11 |
| 3,075,666 | 1/1963 | Hoffstein | 215/11 |
| 3,117,874 | 1/1964 | Horan | 99/171 |
| 3,204,855 | 9/1965 | Boynton et al. | 229/53 |
| 3,255,923 | 6/1966 | Soto | 215/11 E X |
| 3,386,604 | 6/1968 | Fields | 215/11 |
| 3,469,768 | 9/1969 | Repko | 383/906 X |
| 3,537,225 | 11/1970 | Fields | 53/14 |
| 3,586,196 | 6/1971 | Barton et al. | 215/11 |
| 3,651,973 | 3/1972 | Yamauchi | 215/11 |
| 3,746,198 | 7/1973 | Howland | 215/11 |
| 3,782,578 | 1/1974 | Ballin | 215/46 |
| 3,790,017 | 2/1974 | Fitzpatrick et al. | 215/11 |
| 3,796,337 | 3/1974 | Seunevel | 215/11 |
| 3,804,952 | 4/1974 | MacDonald | 426/117 |
| 3,822,806 | 7/1974 | Grimes | 215/11 |
| 3,871,542 | 3/1975 | Hammer | 215/11 |
| 4,183,434 | 1/1980 | Watt | 604/408 X |
| 4,193,506 | 3/1980 | Trindle et al. | 215/11 |
| 4,196,030 | 4/1980 | Ausnit | 222/107 X |
| 4,238,040 | 12/1980 | Fitzpatrick | 215/11 |
| 4,411,358 | 10/1983 | Bennwick et al. | 383/113 X |

FOREIGN PATENT DOCUMENTS

| | | | |
|---|---|---|---|
| 678359 | 1/1964 | Canada | 128/45 |
| 1389552 | 4/1975 | United Kingdom | 222/107 |

*Primary Examiner*—William Price
*Assistant Examiner*—Sue A. Weaver
*Attorney, Agent, or Firm*—Paul C. Flattery; John P. Kirby, Jr.; John J. Ryberg

[57] ABSTRACT

A container such as a nursing container, fabricated from a single web of flexible material, is provided. The container maintains the nursing fluid or other liquid and an attached nipple or other access assembly in a sterile condition until use. The walls of the single web container enclose the nipple during filling, packaging, and shipping, and separate the access assembly from the container contents until accessed for use. Sterility is readily maintained by single point fabrication and filling. A method is provided for fabricating the container from a single web of flexible material. The web is defined, the access assembly, the web folded to enclose the nipple or other access assembly, and folded back to form a liquid compartment. Seals and peelable seals are formed to complete the container and allow access to the nipple for use.

16 Claims, 14 Drawing Figures

FIG. 9
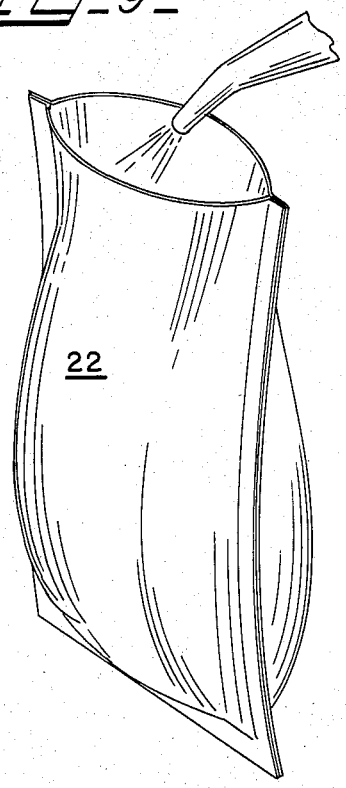
FIG. 3
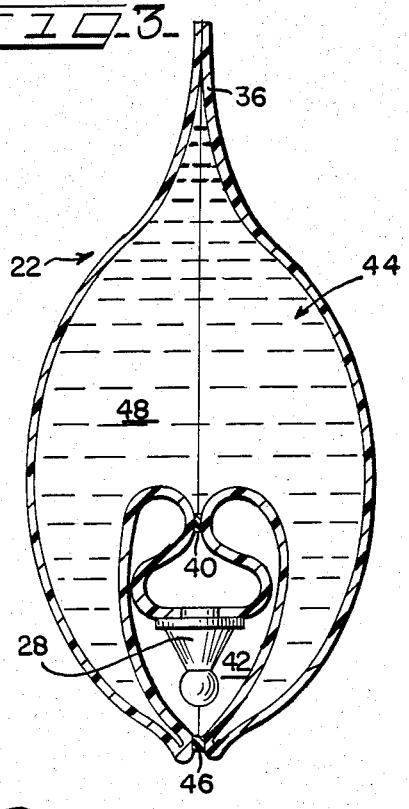
FIG. 4
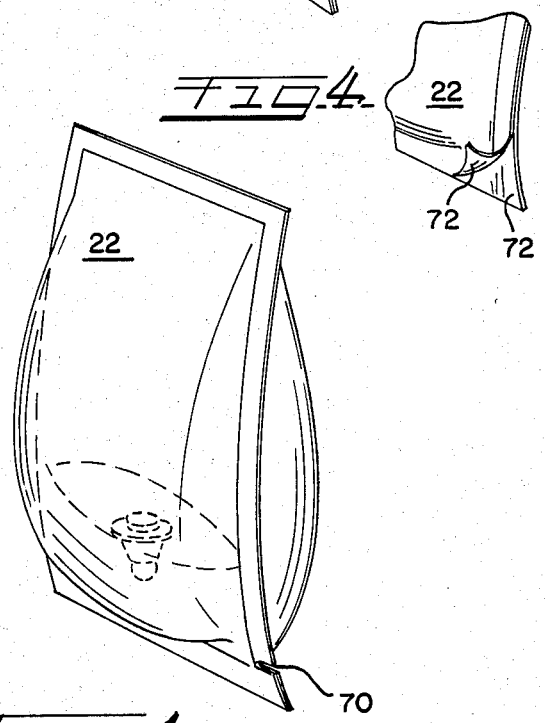
FIG. 5
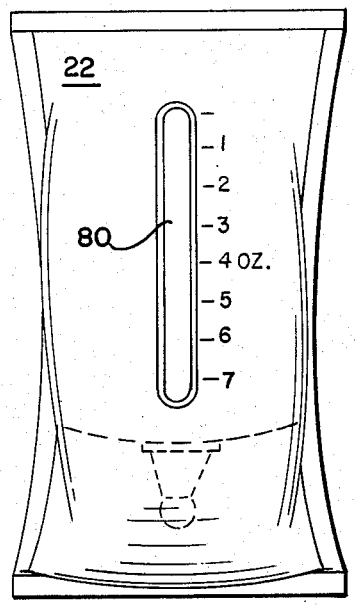
FIG. 1

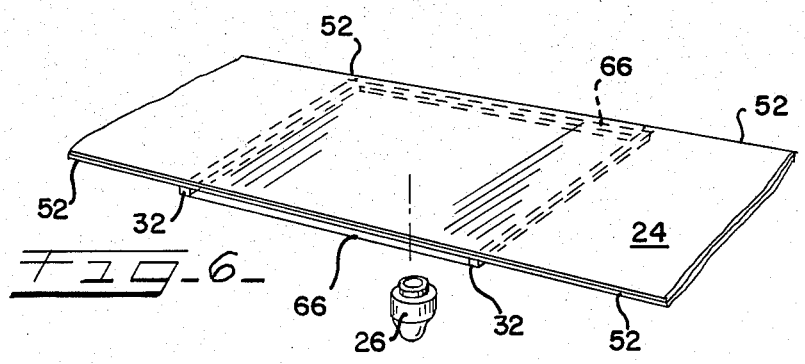
FIG. 6
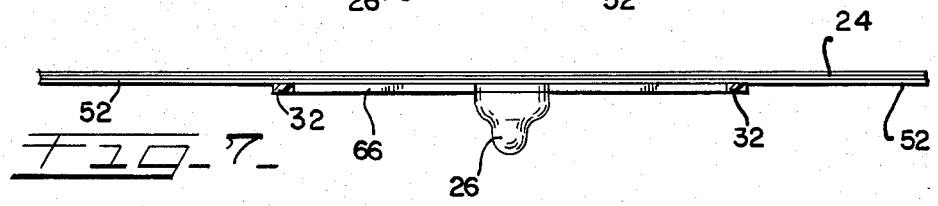
FIG. 7
FIG. 8
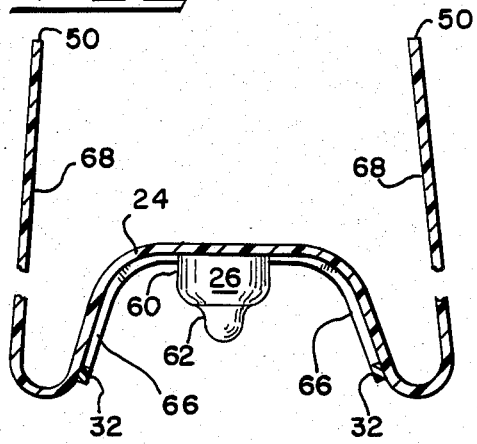
FIG. 2
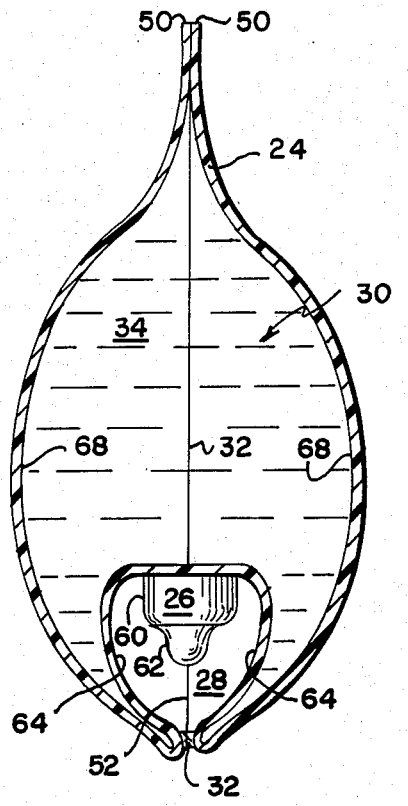

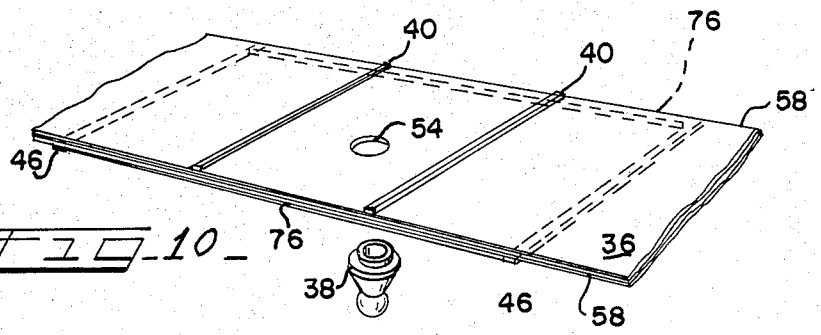
FIG. 10
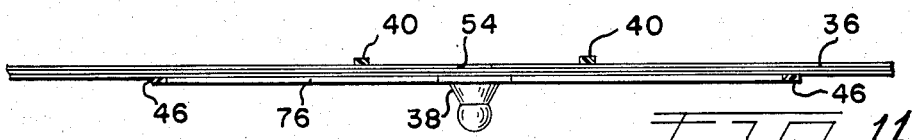
FIG. 11
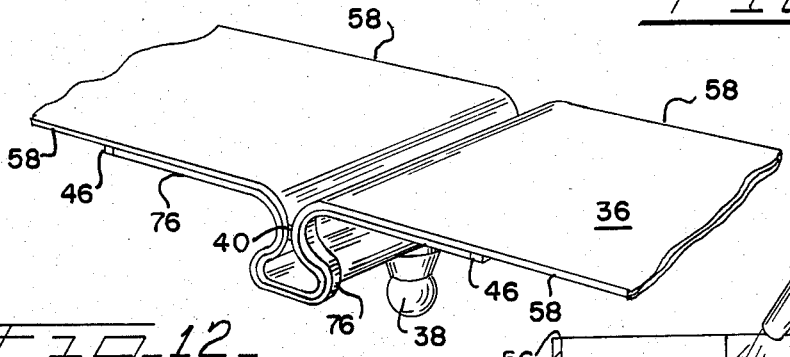
FIG. 12
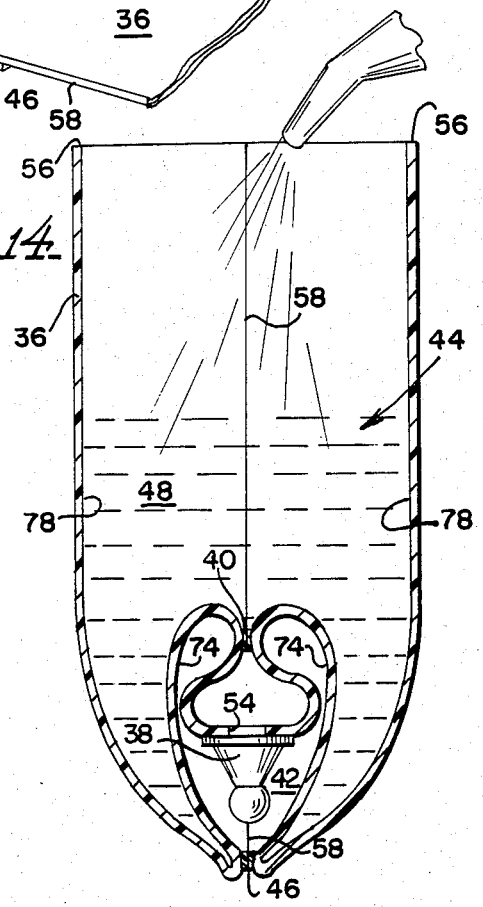
FIG. 14
FIG. 13
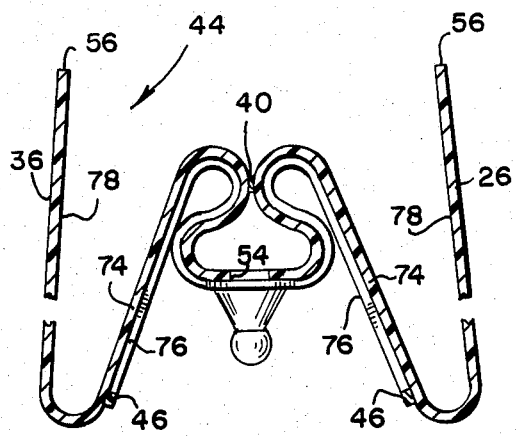

ONE-PIECE NURSING CONTAINER WITH MEANS FOR STORING NIPPLE

The present invention relates generally to nursing containers for feeding infants. More particularly, it relates to a flexible, one-piece nursing container formed to provide a sterile closed compartment for the nipple until needed, and a method for fabricating the one-piece nursing container to enclose the nipple.

In hospital and other institutional environments, it is generally preferred to use pre-filled, pre-sterilized, disposable nursing containers for routine infant feedings. This avoids the time and effort necessary for bottle preparation, clean-up, washing and sterilization. While such nursers have been proposed, as depicted in U.S. Pat. No. 3,586,196 to Barton et al., they have generally employed rigid glass containers which are relatively expensive to ship because of their weight, and are breakable, and most importantly require the entry of displacement air for dispensing of the contents. The presence of air in the container increases the risk of air ingestion by the infant. Moreover, the nipple constructions associated with such air entry sometimes malfunction, resulting in fluid leakage or an inoperable nurser.

While a wide variety of flexible nursing containers have been proposed, as exemplified by U.S. Pat. Nos. 3,117,874 to Horan; 3,289,874 to Daley; 3,386,604 to Field; and 4,193,506 to Trindle, at least one of which discloses a flexible infant nursing container which is filled with nursing fluid at the factory under aseptic conditions, the proposed containers still have shortcomings. The most prevalent of these, even in the more refined containers is the need to manipulate or handle the nipple prior to dispensing the fluid to an infant. Other drawbacks of the prior art include relatively complicated container structures which would be very difficult to produce in a large scale, high speed production facility, which is required to maintain low costs.

Accordingly, it is a primary object of the present invention to overcome the drawbacks associated with the prior art.

It is then a related object to provide a container such as a nursing container of relatively simple construction and which maintains an attached nipple or other access assembly in a sterile condition until use.

It is thus a further object of the present invention to provide a one-piece nursing container for liquid which also encloses an attached nipple in a sterile compartment until needed, and a method for fabricating such a container.

The present invention provides an improved nursing container and a method for making it. More particularly, the present invention provides a nursing container fabricated from a single sheet of flexible material having an attached nipple assembly and constructed so as to enclose the nipple assembly from the time of fabricating until use. Additionally, the present invention provides a novel method for fabricating this nursing container.

The nursing container of the present invention is constructed from a single web of flexible material to which a nipple has been secured. The web is folded to enclose the nipple and peelably sealed so that the nipple may be exposed later for dispensing the nursing fluid. The web is also folded back and sealed along its lateral edges to form a compartment. A selected quantity of liquid is added and the end edges of the web are sealed to fully close the liquid compartment.

The dispensing nipple may be isolated from the container contents until needed, in either of two disclosed methods and container embodiments. In one embodiment, a self-opening nipple assembly of the type disclosed in U.S. patent application Ser. No. 599,305, entitled "Self-opening Nipple Construction and Nursing Container", filed simultaneously herewith in the name of Leonard A. White. This type of nipple is merely bonded to one face of the web and carries internal means for penetrating the web to access the fluid within the compartment for dispensing. An alternative method employs the additional step of folding the web back from the nipple and peelably sealing the web along a transverse line prior to folding the web to enclose the nipple. When this method is used, the peelable seal between the nipple and container contents must be ruptured prior to dispensing the fluid.

Thus, the nursing container of the present invention generally comprises two compartments, an outer and an inner, readily and inexpensively constructed from a single web of flexible material. The inner compartment encloses the nipple and may be ruptured along peelable seal lines to access the nipple. The outer compartment encloses the inner compartment, with the nipple assembly therein, and the liquid to be dispensed. The nipple assembly may be isolated from the liquid in the outer compartment by the web itself when a self-opening nipple is used, or, when a regular nipple is used, separation is maintained by a peelable seal created by pinching the walls of the inner compartment together behind the nipple before the liquid is added to the outer compartment.

The present invention is not limited to a nursing container, but rather may be a container having an access assembly other than a nipple.

These and other objects and advantages of the present invention are set forth in the following detailed description of the accompanying drawings which are intended to illustrate preferred and alternative embodiments of the present invention for purposes of illustration and not limitation and of which:

FIG. 1 is a perspective view of the filled container of the present invention also showing a tear slot in the lower right corner for accessing the nipple;

FIG. 2 is a cross-section of a completed container of the present invention employing a self-opening nipple;

FIG. 3 is a cross-section of the completed alternative container when a standard nipple is used;

FIG. 4 illustrates an alternative embodiment of the means for accessing the nipple;

FIG. 5 illustrates an alternative embodiment of the invention having at least one portion of translucent material and graduations for indicating the amount of fluid in the container;

FIG. 6 is a perspective view of the web to be used in the present invention with a self-opening nipple assembly which is shown in juxtaposition;

FIG. 7 is a side view of the web of FIG. 6 showing the self-opening nipple secured to the web;

FIG. 8 is a cross-section of the web of FIG. 7 folded to bring corresponding portions of the web together to enclose the nipple assembly;

FIG. 9 is a perspective view of a container which has been folded and sealed to form a compartment for liquid;

FIG. 10 is a perspective view showing the top face of the flexible web treated to define various peelable sealing strips and having a defined access port for a standard nipple;

FIG. 11 is a side view of the web of FIG. 10 having the nipple assembly secured thereto;

FIG. 12 is a perspective view showing the top face of the web of FIG. 10 which has been folded back and sealed to isolate the nipple from the contents;

FIG. 13 is a cross-sectional view of the web of FIG. 10 which depicts the step of folding the web to enclose the nipple and folding it back to form the outer liquid compartment; and FIG. 14 is a cross-sectional view of the web of FIG. 10 after the steps of FIG. 13 and which has been sealed to form an outer container and is being filled.

In summary the present invention as shown in FIGS. 1, 2 and 8, provides an improved nursing container 22 comprising a single web 24 of flexible material having a nipple assembly 26 secured thereto. The web 24 is folded together to enclose nipple assembly 26 in an inner compartment 28 and folded back to form an outer compartment 30 for liquid and nipple assembly 26. Inner compartment 28 is accessible by means of peelable seal lines 32 which may be ruptured to access nipple assembly 26. Nursing container 22 further includes a selected quantity of nursing fluid 34.

A further embodiment of the nursing container of the present invention, as shown in FIGS. 3, 13 and 14, comprises a web 36 of flexible material having a nipple assembly 38 secured thereto and peelable seal 40 joining the web 36 together behind nipple assembly 38. Container 22 further comprises an inner compartment 42 defined by folds in web 36 to enclose nipple assembly 38 and an outer compartment 44 defined by folds in web 36 to form a liquid compartment and enclose nipple assembly 38. Peelable seal 46 is rupturable to access nipple assembly 38 for dispensing the nursing fluid 48 contained in outer compartment 44. Peelable seal 40 is also rupturable to allow liquid 48 in compartment 44 to flow to nipple assembly 38.

Nursing container 22 may be fabricated, as depicted in FIGS. 6–8, by defining a web 24 of flexible material and securing a nipple 26 to one side thereof. Web 24 is then transversely folded on each side of nipple assembly 26 to enclose nipple assembly 26. These folds are sealed together by peelable seals 32 which may be ruptured to expose nipple assembly 26 for use. Web 24 is then folded back to bring end portions 50 of web 24 into general facing positions. Web 24 is then sealed along side edges 52 to form a liquid compartment 30 (FIG. 2). A selected quantity of liquid 34 is added to compartment 30, and generally facing end portions 50 are then sealed together.

A second embodiment of container 22 may be fabricated, as shown in FIGS. 11–14, by defining a web of flexible material 36 and securing a nipple assembly 38 to a web access port 54. Web 36 is then folded transversely back from nipple assembly 38 to bring opposite portions of web 36 into generally facing position and sealed along peelable seal lines 40 to isolate nipple 38 (FIG. 12). Web 36 is then folded down around nipple assembly 38 and sealed at frangible seal lines 46 to enclose nipple assembly 38. Web 36 is then folded back to bring opposite sides into general facing positions and opposite end portions 56 into general alignment. Web 36 is then sealed along lateral edges 58 to form a liquid compartment 44 to which a selected quantity of nursing fluid 48 is added. Generally aligned end portions 56 of web 36 are then sealed together to form integral nursing container 22.

More specifically, nursing container 22 illustrated in FIGS. 1 and 2 comprises a single web 24 which has been folded to form inner compartment 28 to enclose nipple assembly 26. Web 24 is further folded back and sealed to form an outer compartment 30 for liquid 34 and nipple assembly 26. Inner compartment 28 may be accessed by rupturing peelable sealing strips 32 to expose nipple assembly 26.

The flexible web 24 is preferably of plastic material which may be heat sealed. Various plastics, such as polyethylene, polypropylene or polyvinylchloride may be used for the web, provided they are inert to the ultimate contents. Web 24 also may be a laminate of various materials. If the container is not enclosed in an overpouch or a package which prevents oxygen transmission, web 24 preferably includes a layer of oxygen barrier material such as Saran plastic of The Dow Chemical Co. which substantially prevents transmission of oxygen to the container contents, thereby providing improved shelf life.

In this embodiment of the present invention, nipple assembly 26 is a self opening nipple of the type disclosed in co-pending application Ser. No. 599,305 by Leonard A. White, entitled "Self-Opening Nipple Construction and Nursing Container", which is secured directly to the web 24. It comprises a base portion 60 and a flexible dispensing portion 62 with an internal communication channel (not shown) connecting the base and dispensing portions. The penetrating means (not shown) is normally disposed within the fluid communication channel and can be manually actuated to penetrate the web 24 to allow fluid to flow from compartment 30 to the flexible dispensing portion 62 and to an infant suckling at nipple assembly 26. Actuation of the penetrating means may be by a number of methods including compression of the nipple. Nipple assembly 26 may be fabricated from suitable elastometric material, such as thermoplastic rubber or other materials suitable for heat bonding to the web, although other means of bonding such as solvent or adhesive may also be used.

Thus, the fluid 34 in outer compartment 30 is kept separated from the nipple assembly 26 until it is desired to dispense the fluid to a nursing infant. It will be appreciated that this arrangement prevents inner compartment 28 from filling with fluid during packaging, handling and shipping.

The folds in web 24 which enclose the nipple assembly define at least two pairs of generally facing walls 64 which may be joined or sealed together by various techniques to form inner compartment 28. Walls 64 are formed as web 24 is folded to enclose nipple assembly 26. The walls 64 are joined together, typically along their periphery, to form the inner compartment 28. Walls 64 are joined along their end portions by peelable sealing strips 32 and along their lateral edges by peelable sealing strips 66 (shown in FIGS. 6–8). Because of the use of peelable methods to seal walls 64 together, they may be separated with little effort when it is desired to access nipple assembly 26 enclosed in inner compartment 28. Peelable sealing strips 32 and 66 may be formed by treating web 24 in defined strip areas by a number of methods known in the art, such as by application of releasable adhesive, coating, primer and the like, or other suitable chemical treatment. Also, the peelable sealing-strips may be formed by applying pre-formed adhesive strips in defined strip areas.

Walls 68 which form the outer compartment 30 are defined by web 24 when it is folded back from the sealing strips 32 to bring opposite end portions 50 into general facing alignment. To form the outer compartment 30, the walls 68 are sealed together, first along their lateral edges 52. After filling, the walls 68 are sealed across their end portions 50 to fully enclose the fluid 34. In contrast to the peelable seals used to join walls 64, walls 68 are joined in a permanent manner, typically by heat sealing, so that access to fluid 34 may be gained only by actuation of a penetrating element in nipple assembly 26 to penetrate web 24 once nipple assembly 26 has been exposed.

Peelable seals 32 and 66 may be ruptured by means of tear slots 70 shown in FIG. 1. Alternatively, as illustrated in FIG. 4, peelable seals 32 and 66 may be separated by pulling apart tabs 72 disposed in a bottom corner of container 22.

FIG. 3 and other related figures illustrate another embodiment of the present invention in which web 36 is folded in a fashion similar to web 24 to form inner and outer compartments and enclose nipple assembly 38 so as to keep it sterile until accessed for use. As with web 24 of the other embodiment, web 36 may be fabricated using any suitable flexible plastic material or laminate. However, in the second embodiment, as illustrated in FIG. 3, web 36 has been additionally folded to peelably isolate nipple assembly 38 from the contents of outer compartment 44. Because nipple assembly 38 in FIG. 3 is a standard nipple assembly which has been connected to web 36 by means of access port 54, it would normally communicate with the fluid 48 inside outer compartment 44 unless it was appropriately isolated. To prevent the flow of fluid 48 from outer compartment 44 through nipple assembly 38 into inner compartment 42, peelable seal 40 is formed to isolate nipple assembly 38 from the contents of outer compartment 44.

Additionally, nipple assembly 38 may be fabricated from any suitable elastometric material, such as thermoplastic rubber. The illustrated construction is intended to indicate a standard nipple assembly and any number of such nipples as known in the art would suffice. Nipple assembly 38 is typically permanently bonded to web 36 at access port 54, but other suitable means of attachment may also be used.

Specifically, to effectively isolate nipple assembly 38, web 36 is folded away from nipple assembly 38 to bring peelable sealing strips 40 into general opposed alignment. These strips 40 are then sealed to form a peelable seal which may be ruptured to allow fluid to flow from compartment 44 to nipple assembly 38. After the web 36 has been joined along peelable sealing strips 40 behind nipple assembly 38, the web 36 is folded to define generally opposing walls 74 as shown in FIG. 13. Walls 74 are joined by peelable sealing strips 46 at their extreme end and by peelable sealing strip 76 on their lateral edges (shown in FIGS. 10–13) to form inner compartment 42. Inner compartment 42 may be accessed to expose nipple assembly 38 for use by rupturing peelable seals 46 and 76. Peelable seals 40, 46 and 76 may be formed in a manner similar to peelable seals 32 and 66 discussed above.

Web 36 may then be folded back from peelable seal 46 to define another pair of generally opposed wall panels 78. Wall panels 78 are joined along their lateral edges 58 to form outer compartment 44 which may then be filled with a nursing fluid 48 as illustrated in FIG. 14. Once outer compartment 44 has been filled with the desired quantity of nursing fluid 48, walls 78 are further joined along their end portions 56 to seal outer compartment 44. It will be appreciated that the seals defining outer compartment 44 are of a permanent nature, typically created by heat sealing the flexible material together, and are designed to assure that access may only be gained to nursing fluid 48 by first rupturing peelable seals 46 and 76 to expose nipple assembly 38 and rupturing peelable seal 40 to allow fluid communication between the fluid 48 in outer compartment 44 and nipple assembly 38.

Similarly to the embodiment of FIG. 2, the embodiment of FIG. 3 may be opened, that is, inner compartment 42 ruptured to expose nipple assembly 38, by means of a tear notch 70 as illustrated in FIG. 1. Alternatively, inner compartment 42 may be ruptured by separating tabs 72 disposed in a lower corner of container 22 as illustrated in FIG. 4.

In the various embodiments discussed above, pairs of peelable sealing strips 32, 40, 46, 66 and 76 are formed on various faces of the webs 24 and 36 at different points in the fabrication process. In the preferred embodiment, each of these pairs is defined on the appropriate web face symmetrically with respect to the nipple assembly, which is typically centrally disposed on the web. That is, the distance between the sealing strip and the nipple is approximately equal to the distance between the nipple and the corresponding strip of that pair. Although this is the pictured embodiment and is believed to be the most convenient from a manufacturing standpoint, this particular symmetrical relationship could be changed without departing from the present invention.

Sterility may be achieved in each of the above-discussed embodiments by forming, filling and sealing the container 22 in aseptic conditions at a processing or manufacturing plant. Alternatively, the entire assembly and contents may be sterilized as a unit after filling. Thus, the contents and dispensing nipple may be readily maintained in a sterile condition until use. Also, as may be appreciated from the description of container 22 herein, no preparation is required by the user.

FIG. 5 illustrates an alternative embodiment for each of the previously described nursing containers. Web 36 or 24 may be modified to include a portion of translucent or transparent material 80 as shown in FIG. 5. Translucent portion 80, when taken in conjunction with the graduations indicated on one side of the container 22, can be used to monitor the contents of nursing container 22 and the amount of nursing fluid which has been taken by the infant. Alternatively, the entire web 36 or 24 may be made of translucent or transparent material with the graduations being made sufficiently contrasting to allow a reading of the fluid level in the container 22.

The method used to fabricate the improved nursing container 22 may be more fully understood with reference to the sequence of FIGS. 6–8 and, alternatively, 10–14. Specifically, the nursing container embodiment of FIG. 2 may be formed by first defining a web 24 as shown in FIG. 6. Web 24 is then treated in the manner described above to define peelable sealing strips 32 transversely across web 24 and peelable sealing strips 66 longitudinally along the lateral edges of web 24, on the same side of the web as the nipple assembly 26. As shown in FIGS. 6 and 7, nipple assembly 26 is then secured to web 24 as explained above without penetrating the web itself. Web 24 may then be folded about nipple assembly 26 to define generally opposed walls 64 and align peelable sealing strips 32 and the now generally opposite portions of peelable sealing strips 66. Once these strips have been joined together to form the rupturable inner compartment 28, web 24 may then be folded back again to bring opposite end portions 50 into general alignment. At this time, the lateral edges 52 of web 24 and generally opposed wall panels 68 are sealed together to form a permanent seal. This action defines an internal outer compartment 30 which may be filled with nursing fluid 34 as illustrated in FIG. 9. Once outer compartment 30 has been filled with the desired quantity of liquid 34, opposite end portions 50 of web 24 are sealed together in a permanent sealing process.

In a similar fashion, the nursing container of FIG. 3 is likewise formed from a single web 36 of flexible material. Specifically, a web 36 is defined as shown in FIG. 10. On the top face of web 36, transverse peelable sealing strips 40 are defined on either side of the nipple aperture 54. Additionally, on the opposite, or bottom face of web 36, transverse peelable sealing strips 46 are provided at a greater distance from nipple aperture 54 than strips 40. Longitudinal peelable sealing strips 76 on the bottom of the web extend between transverse peelable sealing strips 46. The nipple assembly 38 is secured to the bottom face of web 36 at access port 54. Once the nipple 38 has been secured, web 36 is folded back to bring peelable sealing strips 40 into generally opposed alignment. These strips 40 are sealed to form a liquid-tight seal line to isolate nipple assembly 38 from the yet-to-be-defined outer compartment 44. Once peelable sealing strips 40 have been joined together as shown in FIG. 12, web 36 is folded down to enclose nipple assembly 38 and bring peelable sealing strips 46 into generally opposed alignment as illustrated generally in FIG. 13. At this point, peelable sealing strips 46 are sealed together as are peelable sealing strips 76 along the lateral edges of generally facing walls 74. By this action, inner compartment 42 is formed to enclose nipple assembly 38.

Once inner compartment 42 has been formed, web 36 is then folded back from peelable sealing strips 46 to further define generally facing walls 78 which form the outer container. These walls 78 extend from about peelable sealing strip 46 to opposite end portions 56 of web 36. Walls 78 are then sealed along their lateral edges to form the outer compartment 44, which may then be filled with liquid 48 as illustrated generally in FIG. 14. Once the outer compartment 44 has been filled with the desired quantity of nursing fluid 48, opposite end portions 56 of web 36 are sealed together in a permanent manner. This forms the integral nursing container as illustrated in cross-section in FIG. 3 and in a general perspective view in FIG. 1.

It is believed that the novel features of the present invention are set forth with particularity in the appended claims. However, it is intended that such changes and modifications as would be apparent to one skilled in the art and familiar with the teachings of this application also be within the scope of the appended claims and it is not intended that the present invention be limited to the specific embodiments disclosed.

What is claimed is:

1. A nursing container comprising:

a web of flexible material having transverse and longitudinal dimensions;

a nipple assembly secured to said web and generally centrally disposed on one face of said web, the nipple assembly being a standard nipple assembly;

a first pair of side panels defined in said web on either side of said nipple assembly and joined together to enclose said nipple assembly;

means defining a peelable seal between said first pair of side panels to enclose said nipple assembly and adapted to access said nipple assembly for use;

a second pair of side panels extending from said first pair of side panels to the end of said web, the sides and ends of said second pair of side panels being joined together to form a liquid compartment;

a quantity of liquid in said liquid compartment;

said first pair of joined side panels form an inner compartment to enclose said nipple assembly and said second pair of joined side panels form an outer compartment for liquid and said nipple assembly;

an access port in said web communicating with said nipple assembly and said liquid compartment; and means for defining a liquid tight peelable seal within said liquid compartment to close fluid communication with said access port until ruptured for use.

2. The nursing container of claim 1 wherein said means defining a liquid tight, peelable seal comprises a pair of transverse peelable sealing strips defined on the opposite of said one face of said web symmetrically with respect to said centrally disposed nipple assembly, said web being folded back to bring said pair into general alignment and transversely sealed along said peelable strips.

3. The nursing container of claim 1 wherein said means defining a peelable seal between said first pair of side panels comprises:

a pair of transverse peelable sealing strips defined on said one face of said web and spaced symmetrically with respect to said centrally disposed nipple assembly;

a pair of longitudinal peelable sealing strips defined on said one face of said web, said longitudinal strips being spaced symmetrically with respect to said centrally disposed nipple assembly, and extending between said pair of transverse peelable strips;

said web being folded about said nipple assembly toward said one face to bring said pair of transverse peelable sealing strips into general alignment and generally opposite longitudinal portions of said longitudinal peelable sealing strips into generally opposed alignment.

4. The nursing container of claim 1 wherein at least a portion of said web is of transparent material and further including:

graduation markings on said web adjacent said transparent portion to indicate the quantity of said liquid in said liquid compartment.

5. The nursing container of claim 1 further including:

means for rupturing said peelable seal between said first pair of side panels.

6. The nursing container of claim 5 wherein said means for rupturing comprises at least one tear slot in said sealed web side to a depth less than the width of said side seal.

7. The nursing container of claim 5 wherein said means for rupturing comprises at least one pair of tabs integral with said first pair of side panels and adapted to be pulled apart to rupture said peelable seal between said first pair of side panels.

8. A container comprising:

a web of flexible material having transverse and longitudinal dimensions;

an access assembly secured to said web and generally centrally disposed on one face of said web;

a first pair of side panels defined in said web on either side of said access assembly and joined together to enclose said access assembly;

means defining a peelable seal between said first pair of side panels to enclose said access assembly and adapted to access said access assembly for use;

a second pair of side panels extending from said first pair of side panels to the end of said web, the sides and ends of said second pair of side panels being joined together to form a liquid compartment;

a quantity of liquid in said liquid compartment;

an access port in said web communicating with said access assembly and said liquid compartment; and means defining a liquid tight peelable seal within said liquid compartment to close fluid communication with said access port until ruptured for use.

9. The container of claim 8 wherein said means defining a liquid tight, peelable seal comprises a pair of transverse peelable sealing strips defined on the opposite of said one face of said web symmetrically with respect to said centrally disposed access assembly, said web being folded back to bring said pair into general alignment and transversely sealed along said peelable strips.

10. The container of claim 8 wherein said means defining a peelable seal between said first pair of side panels comprises:

a pair of transverse peelable sealing strips defined on said one face of said web and spaced symmetrically with respect to said centrally disposed access assembly;

a pair of longitudinal peelable sealing strips defined on said one face of said web, said longitudinal strips being spaced symmetrically with respect to said centrally disposed access assembly, and extending between said pair of transverse peelable strips;

said web being folded about said access assembly toward said one face to bring said pair of transverse peelable sealing strips into general alignment and generally opposite longitudinal portions of said longitudinal peelable sealing strips into generally opposed alignment.

11. The container of claim 8 wherein at least a portion of said web is of transparent material and further including:

graduation markings on said web adjacent said transparent portion to indicate the quantity of said liquid in said liquid compartment.

12. The container of claim 8 further including:

means for rupturing said peelable seal between said first pair of side panels.

13. The container of claim 12 wherein said means for rupturing comprises at least one tear slot in said sealed web side to a depth less than the width of said side seal.

14. The container of claim 12 wherein said means for rupturing comprises at least one pair of tabs integral with said first pair of side panels and adapted to be pulled apart to rupture said peelable seal between said first pair of side panels.

15. A nursing container comprising:

a web of flexible material having transverse and longitudinal dimensions;

a nipple assembly secured to said web;

a first pair of side panels defined in said web on either side of said nipple assembly and joined together to enclose said nipple assembly;

means defining a peelable seal between said first pair of side panels to enclose said nipple assembly and adapted to access said nipple assembly for use;

a second pair of side panels extending from said first pair of side panels to the end of said web, the sides and ends of said second pair of side panels being joined together to form a compartment, said compartment being divided into two smaller compartments by a peelable seal;

said two smaller compartments defining a first compartment for containing a quantity of liquid and a second compartment for preventing fluid communication between the first compartment and nipple.

16. A container comprising:

a web of flexible material having transverse and longitudinal dimensions;

an access assembly secured to said web;

a first pair of side panels defined in said web on either side of said access assembly and joined together to enclose said access assembly;

means defining a peelable seal between said first pair of side panels to enclose said access assembly and adapted to access said access assembly for use;

a second pair of side panels extending from said first pair of side panels to the end of said web, the sides and ends of said second pair of side panels being joined together to form a liquid compartment;

a quantity of liquid in said liquid compartment; and said liquid compartment including means for defining a liquid tight peelable seal within said liquid compartment to prevent fluid communication between the liquid and the access assembly until the seal is ruptured.

* * * * *